US008764387B2

(12) United States Patent
Jordan et al.

(10) Patent No.: US 8,764,387 B2
(45) Date of Patent: Jul. 1, 2014

(54) AGGREGATE VANE ASSEMBLY

(75) Inventors: Matthew Joseph Jordan, Indianapolis, IN (US); Eric W. Engebretsen, Westfield, IN (US); Benedict N. Hodgson, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 669 days.

(21) Appl. No.: 13/012,878

(22) Filed: Jan. 25, 2011

(65) Prior Publication Data

US 2012/0189432 A1 Jul. 26, 2012

(51) Int. Cl.
*F02K 3/02* (2006.01)

(52) U.S. Cl.
USPC ..... 415/144

(58) Field of Classification Search
USPC ..... 415/115, 116, 144, 145, 176, 177, 178, 415/185, 186, 189, 209.2, 209.3; 416/244 R, 416/245 A
See application file for complete search history.

(56) References Cited

U.S. PATENT DOCUMENTS

| | | | | |
|---|---|---|---|---|
| 3,375,971 | A * | 4/1968 | Fitton | 415/209.4 |
| 3,834,157 | A * | 9/1974 | Hoffmann | 60/39.093 |
| 4,867,635 | A | 9/1989 | Tubbs | |
| 5,184,459 | A | 2/1993 | McAndrews | |
| 5,201,801 | A | 4/1993 | Smith, Jr. | |
| 6,195,983 | B1 | 3/2001 | Wadia et al. | |
| 6,438,941 | B1 | 8/2002 | Elliot et al. | |
| 7,618,232 | B2 | 11/2009 | Bil et al. | |
| 8,205,426 | B2 * | 6/2012 | Schilling | 60/39.08 |
| 2003/0035719 | A1 * | 2/2003 | Wadia et al. | 415/145 |

FOREIGN PATENT DOCUMENTS

| | | |
|---|---|---|
| EP | 1 757 796 | 2/2007 |
| EP | 2 397 654 | 12/2011 |

OTHER PUBLICATIONS

UK Search Report; Application No. GB1201327.2; Date of Search May 24, 2012.

* cited by examiner

*Primary Examiner* — Richard Edgar
(74) *Attorney, Agent, or Firm* — Krieg DeVault, LLP

(57) ABSTRACT

An aggregate vane assembly includes a core vane assembly encircling a central longitudinal axis and having a plurality of core vanes each extending radially between an inner hub and an outer band. The aggregate vane assembly also includes a bypass vane assembly disposed on a radially opposite side of the outer band relative to the plurality of core vanes. The aggregate vane assembly also includes a splitter ring positioned proximate to the first forward end. The aggregate vane assembly also includes at least one retention plate overlapping a forward end of the at least one bypass vane along the central longitudinal axis and also overlapping at least a portion of the splitter ring along the central longitudinal axis.

19 Claims, 3 Drawing Sheets

AGGREGATE VANE ASSEMBLY

BACKGROUND OF THE INVENTION

1. Field of the Invention

The invention relates to a component for splitting flow, such as in a turbine engine.

2. Description of Related Prior Art

U.S. Pat. No. 4,867,635, assigned to Rolls-Royce plc, discloses a variable guide vane arrangement for a compressor. The variable guide vane arrangement comprises a plurality of stator vanes rotatably mounted in a stator structure of the compressor. A control ring surrounds and is normally coaxially with the compressor axis, and a plurality of operating levers extends from the control ring to their respective stator vane. The control ring is movable laterally with respect to the axis of the compressor so that the stator vanes in a first half of the compressor are rotated in one direction so that the first half of the compressor operates at a higher pressure ratio and the stator vanes in a second half of the compressor are rotated in the opposite direction so that the second half of the compressor operates at a lower pressure ratio. The half of the compressor operating at a higher pressure ratio is arranged to coincide with a zone of the compressor which has a low intake pressure caused by the inlet flow distortions.

SUMMARY OF THE INVENTION

In summary, the invention is an aggregate vane assembly. The aggregate vane assembly includes a core vane assembly encircling a central longitudinal axis and having a plurality of core vanes each extending radially between an inner hub and an outer band. The core vane assembly extends along the central longitudinal axis between a first forward end and a first aft end. The aggregate vane assembly also includes a bypass vane assembly disposed on a radially opposite side of the outer band relative to the plurality of core vanes. The bypass vane assembly includes at least one bypass vane extending radially outward from a platform. The bypass vane assembly extends along the central longitudinal axis between a second forward end and a second aft end. The aggregate vane assembly also includes a splitter ring positioned proximate to the first forward end. The aggregate vane assembly also includes at least one retention plate overlapping a forward end of the at least one bypass vane along the central longitudinal axis and also overlapping at least a portion of the splitter ring along the central longitudinal axis. The splitter ring is releasably engaged with both of the outer band and the at least one retention plate.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF AN EXEMPLARY EMBODIMENT

The invention, as demonstrated by the exemplary embodiment described below, provides an aggregate vane assembly having simplified manufacture and assembly. The splitter ring is non-integral to both the outer band of the core vane assembly and to the bypass vane retention component. This allows for the use of a segmented bypass vane retention component without the manufacturing difficulties associated with an integral splitter ring on the core vane assembly. Machining a splitter nose on a fabricated core vane assembly is difficult from a manufacturing perspective. The forward edge of the outer band of the core vane assembly can have a relatively large tolerance when compared to the fan flow-path surfaces. Using a separate splitter ring part allows for more tightly controlled tolerances on the splitter ring and improved aerodynamic performance. Another advantage provided by the exemplary embodiment is that the splitter ring may be replaced more readily and with less expense in the event of foreign object damage (FOD). The splitter ring is subject to being damaged from FOD. The exemplary splitter ring can be replaced at a lower cost than a splitter that is either integral to the outer band or to the bypass vane retention component. Furthermore, the vanes, which can also be damaged by FOD, can also be replaced more readily in the exemplary embodiment of the invention.

Figure 1:
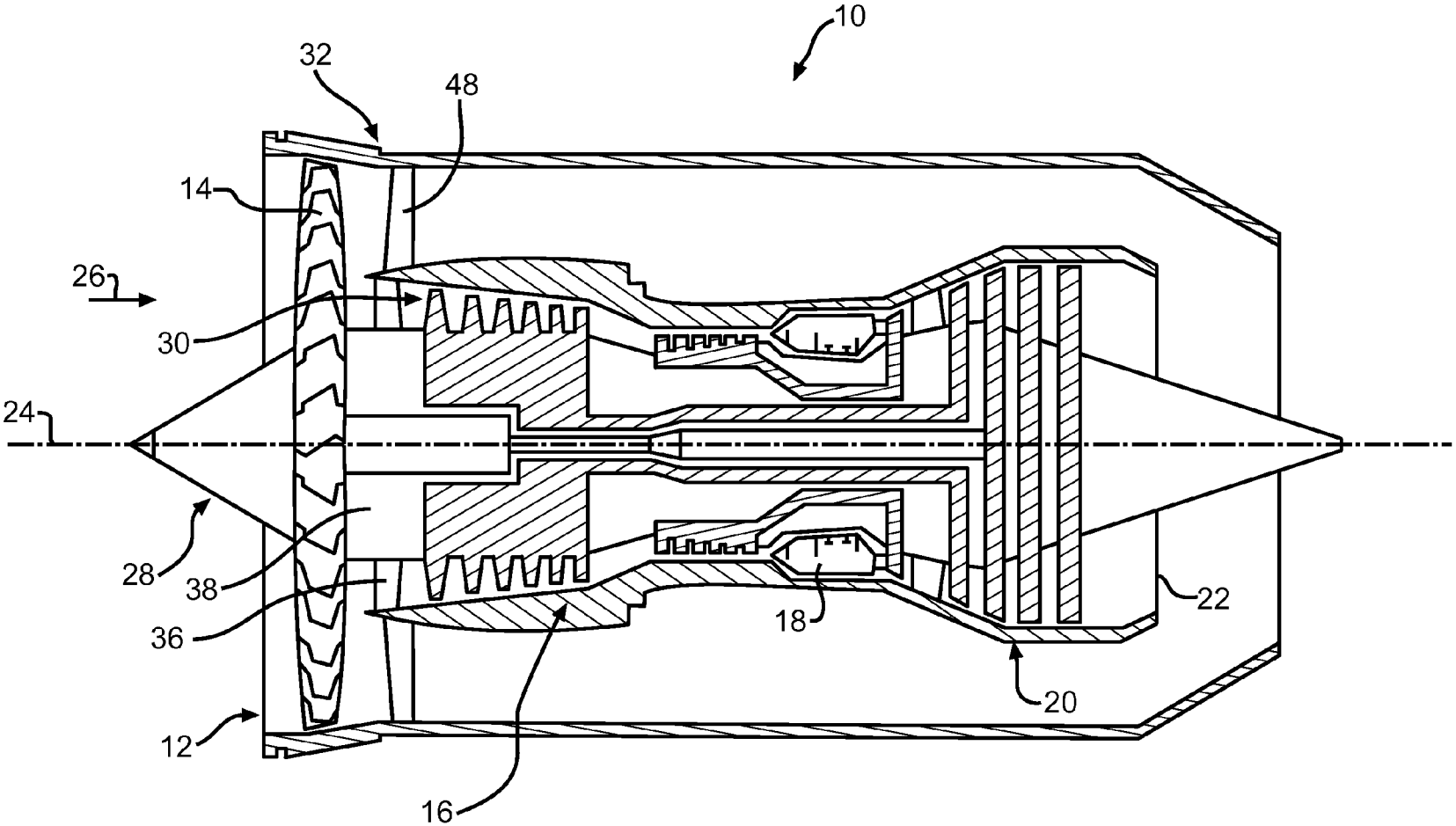
FIG. 1 is a schematic cross-section of a turbine engine incorporating an exemplary embodiment of the invention.

Referring to FIG. 1, a turbine engine 10 can include an inlet 12 and a fan 14. A nose cone assembly 28 can be attached to the fan 14. The exemplary fan 14 can be a bladed disk assembly having a disk or hub defining a plurality of slots and a plurality of fan blades, each fan blade received in one of the slots. The turbine engine can also include a compressor section 16, a combustor section 18, and a turbine section 20. The turbine engine 10 can also include an exhaust section 22. The fan 14, compressor section 16, and turbine section 20 are all arranged to rotate about a centerline axis 24. Fluid such as air can be drawn into the turbine engine 10 as indicated by the arrow referenced at 26. The fan 14 directs fluid to the compressor section 16 where it is compressed. The compressed fluid is mixed with fuel and ignited in the combustor section 18. Combustion gases exit the combustor section 18 and flow through the turbine section 20. Energy is extracted from the combustion gases in the turbine section 20.

Figure 2:
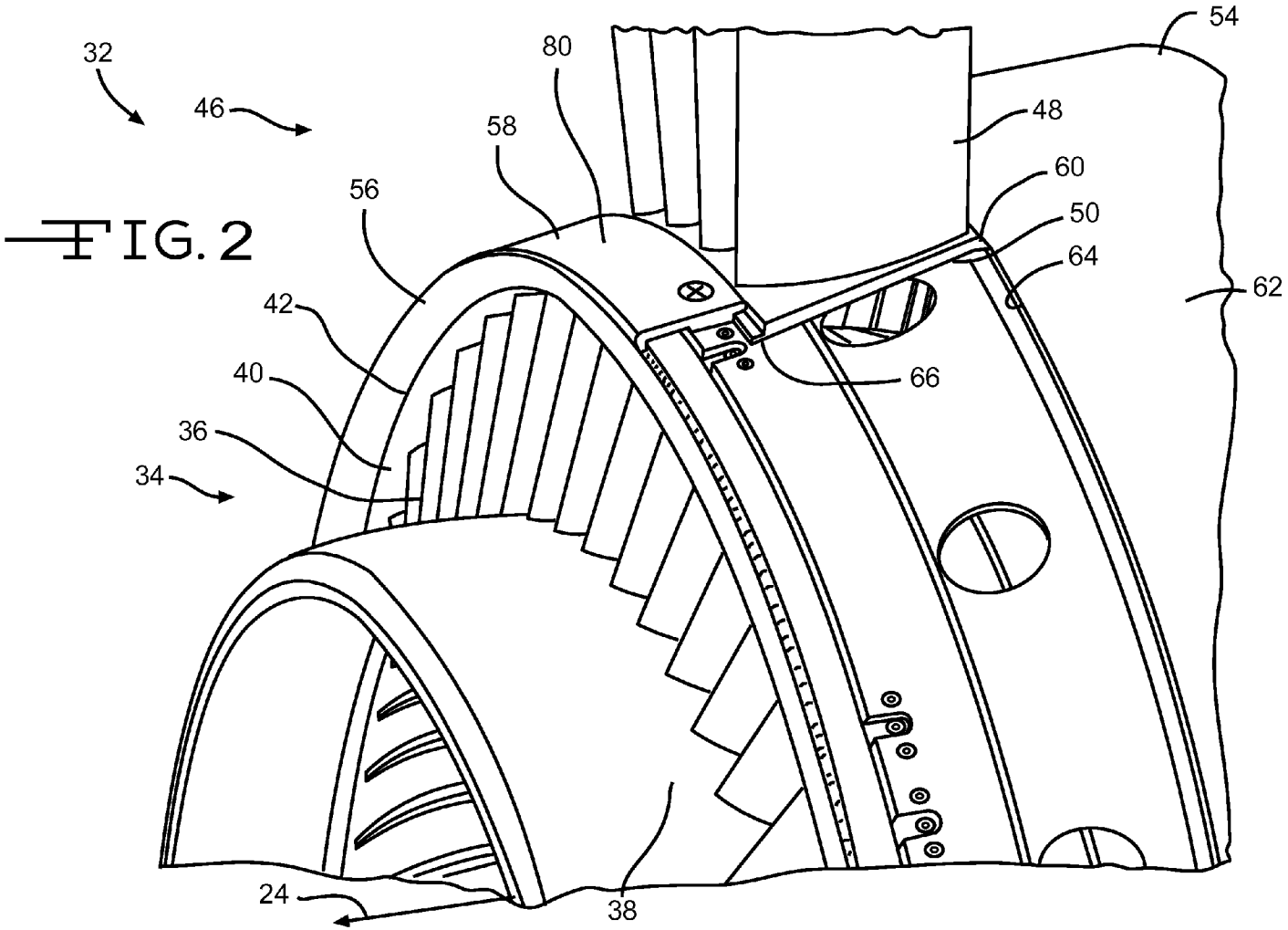
FIG. 2 is a partial perspective view of the exemplary embodiment of the invention.
Figure 3:
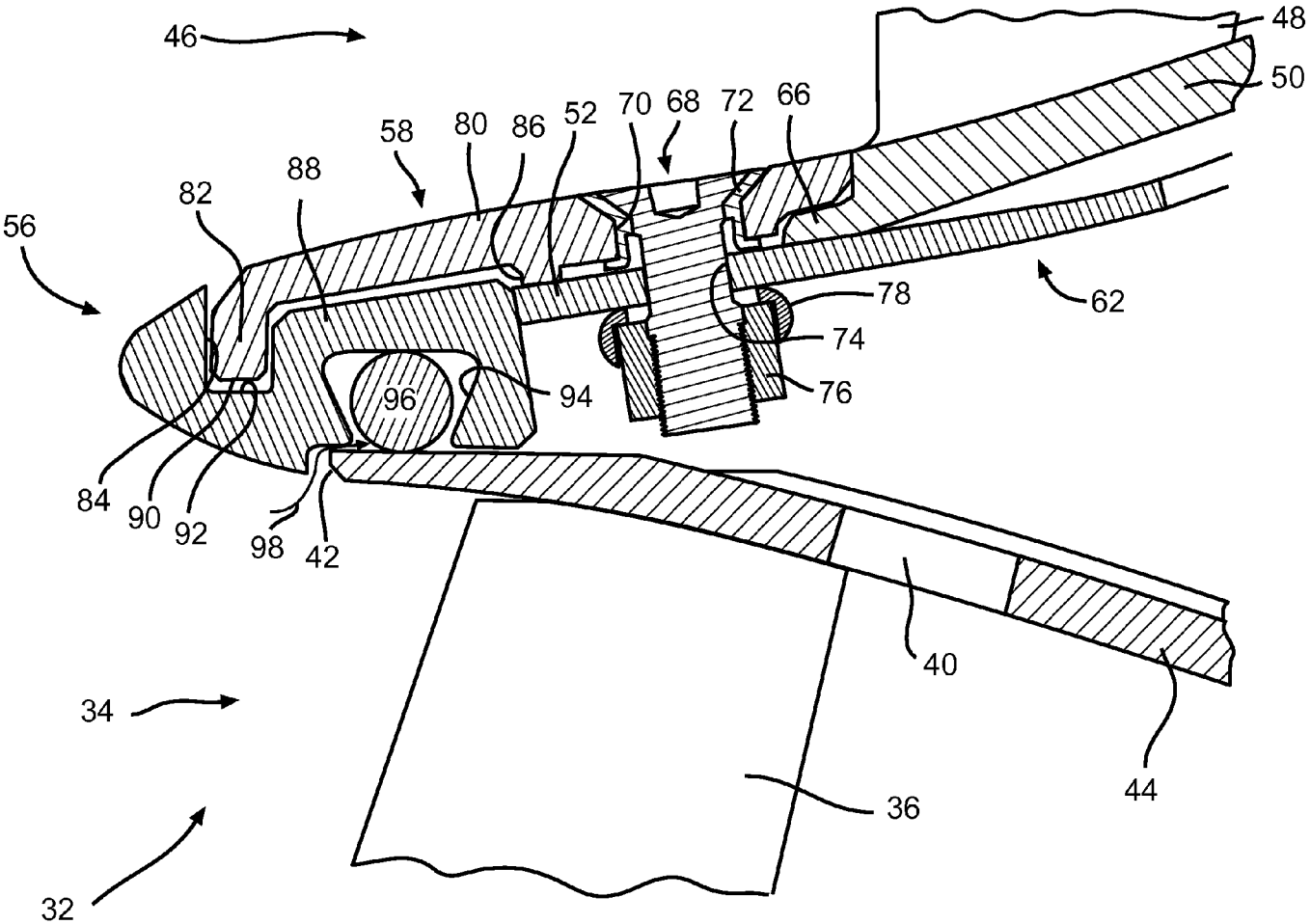
FIG. 3 is a partial cross-section taken through plane containing the centerline axis of the turbine engine.

The compressor section 16 includes an intake 30. An aggregate vane assembly 32 is positioned upstream and proximate to the intake 30 along the axis 24. As shown in FIGS. 2-3, the aggregate vane assembly 32 includes a core vane assembly 34 encircling a central longitudinal axis. In the exemplary embodiment, the central longitudinal axis 24 is collinear with the centerline axis 24 of the turbine engine 10, shown in FIG. 1. The core vane assembly 34 has a plurality of core vanes 36 each extending radially between an inner hub 38 and an outer band 40. The core vane assembly 34 extends along the central longitudinal axis 24 between a first forward end 42 and a first aft end 44.

The aggregate vane assembly 32 also includes a bypass vane assembly 46 disposed on a radially opposite side of the outer band 40 relative to the plurality of core vanes 36. The bypass vane assembly 46 includes at least one bypass vane 48 extending radially outward from a platform 50. The bypass vane assembly 46 can include more than one bypass vane extending from a common platform 50. A plurality of individual bypass vane assemblies 46 can be positioned fully around the core vane assembly 34.

The exemplary bypass vane assembly 46 also includes a bypass flowpath or bypass flow ring 62 encircling the central longitudinal axis 24 and the outer band 40. The bypass flow ring 62 defines a radially inner boundary for fluid flow downstream of the plurality of vanes 48. The plurality of bypass vanes 48 are releasably engaged with the bypass flow ring 62. The bypass vane assembly 46 extends along the central longitudinal axis 24 between a second forward end 52 and a second aft end 54. In the exemplary embodiment, the bypass flow ring 62 can define both ends 52, 54.

A splitter ring 56 can be positioned upstream of the plurality of core vanes 36 and also upstream of the at least one bypass vane 48. The splitter ring 56 can bifurcate the flow of fluid in the turbine engine 10. The core engine flow can pass inside the outer band 40 and the bypass flow can pass outside the outer band 40. The exemplary splitter ring 56 can be formed as a single, unitary structure extending 360° about the central longitudinal axis 24.

The aggregate vane assembly 32 also includes at least one retention plate 58. The exemplary aggregate vane assembly 32 includes a plurality of similarly configured retention plates 58 arranged circumferentially and abutting one another about the axis 24. Each of the retention plates 58 overlap a forward end of at least one bypass vane 48 (such as the forward end 66 of the platform 50) along the central longitudinal axis 24. The bypass flow ring 62 and the retention plates 58 cooperate to limit movement of the vanes 48 in the exemplary embodiment. The aft end 60 of the platform 50 is received in a groove 64 defined by the bypass flow ring 62. The groove 64 and the overlapping portion of the retention plate 58 fix the platform 50 and the vane 48 in a desired position.

In the exemplary embodiment of the broader invention, a fastener 68 can extend through an aperture 70 in the retention plate 58 for interconnecting the bypass flow ring 62 and the at least one retention plate 58. The exemplary fastener 68 is a captured bolt, having a sleeve portion 72 that is swaged on one side of the aperture 70. The exemplary fastener 68 is rotatable in the aperture 70, but not removable from the retention plate 58.

The fastener 68 can also extend through an aperture 74 in the bypass flow ring 62 and threadingly engage a nut 76. The nut 76 can be captured by a nut plate 78 and the nut plate 78 can be riveted to the bypass flow ring 62. The nut 68 can be fixed against rotation by the nut plate 78.

The exemplary retention plate 58 includes a plate portion 80 extending circumferentially about the central longitudinal axis 24 and a flange portion 82 extending radially away from the plate portion 80 relative to the central longitudinal axis 24. The exemplary flange portion 82 extends radially inward. The plate portion 80 overlaps a portion of the splitter ring 56 along the central longitudinal axis 24. The exemplary retention plate 58 can thus define more of the fluid flow path, the exemplary splitter ring 56 only being especially important at the point where the fluid flow is bifurcated.

The flange portion 82 is received in a circumferential groove 84 defined by the splitter ring 56. The exemplary circumferential groove 84 is positioned forward of the first forward end 42 of the outer band 40. As shown by FIG. 3, a portion of the splitter ring 56 can be captured along the central longitudinal axis between a portion of the at least one retention plate 58 (the flange 82) and a bypass flow ring 62 (the end 52). This arrangement fixes the position of the splitter ring 56 along the axis 24.

The exemplary retention plate 58 is shaped such that a groove 86 is formed and the splitter ring 56 defines a flange portion 88 received in the groove 86. The retention plate 58 and splitter ring 56 can thus be interlocked together with mating flange portions and grooves. Also, the arrangement allows the splitter ring 56 to be releasably engaged with the retention plate 58.

The radial height of the flange portion 82 is less than a radial depth of the circumferential groove 84 such that a radially-innermost end 90 of the flange portion 82 is spaced radially from a bottom 92 of the circumferential groove 84. The gap between the end 90 and the bottom 92 accommodates variation in the relative sizes of the various components arising from manufacturing tolerances. Also, the gap renders the components at least partially moveable relative to one another, although in operation of the exemplary embodiment it is not expected that significant relative movement will occur.

The splitter ring 56 is also releasably engaged to the outer band 40 and positioned proximate to the first forward end 42 along the axis 24. The splitter ring 56 can include a circumferential groove 94 open radially inward relative to the central longitudinal axis 24. As shown in FIG. 3, the first and second circumferential grooves 84 and 94 face in opposite radial directions relative to the central longitudinal axis 24. An o-ring 96 can be at least partially positioned in the circumferential groove 94. The o-ring 96 can be positioned between the splitter ring 56 and the outer band 40 and seal these components relative to one another. The o-ring 96 is one example of an elastic member that can be positioned between the splitter ring 56 and the outer band 40 to accommodating variation in the size and circularity of the outer band 40. The elasticity of the o-ring 96 renders the splitter ring 56 and the outer band 40 at least partially moveable relative to one another, although in operation of the exemplary embodiment it is not expected that significant relative movement will occur. The o-ring 96 can be positioned between the splitter ring 56 and the outer band 40 such that a torturous path is defined between the splitter ring 56 and the outer band 40, to reduce the tendency of fluid passing to the o-ring 96. The torturous path can extend from the primary fluid flow path to the o-ring 96 and is referenced at arrow 98. Generally, a "torturous" path refers to a path wherein fluid must make at least two ninety degree turns during flow.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Further, the "invention" as that term is used in this document is what is claimed in the claims of this document. The right to claim elements and/or sub-combinations that are disclosed herein as other inventions in other patent documents is hereby unconditionally reserved.

What is claimed is:

1. An aggregate vane assembly comprising:

a core vane assembly encircling a central longitudinal axis and having a plurality of core vanes each extending radially between an inner hub and an outer band wherein said core vane assembly extends along said central longitudinal axis between a first forward end and a first aft end;

a bypass vane assembly disposed on a radially opposite side of said outer band relative to said plurality of core vanes, said bypass vane assembly including at least one bypass vane extending radially outward from a platform and said bypass vane assembly extending along said central longitudinal axis between a second forward end and a second aft end;

a splitter ring positioned proximate to said first forward end;

at least one retention plate overlapping a forward end of said at least one bypass vane along said central longitudinal axis and also overlapping at least a portion of said splitter ring along said central longitudinal axis, wherein said splitter ring is releasably engaged with both of said outer band and said at least one retention plate;

wherein said at least one retention plate further comprises a plate portion extending circumferentially about said central longitudinal axis and a flange portion proximate a forward end and extending radially away from said plate portion relative to said central longitudinal axis; and said splitter ring further comprises a first circumferential groove having a pair of sidewalls extending from a bottom wall, the first groove extending circumferentially about said central longitudinal axis, and said flange portion received in said first groove.

2. The aggregate vane assembly of claim 1 wherein said flange portion extends radially inward.

3. The aggregate vane assembly of claim 1 wherein said first circumferential groove is positioned forward of said first forward end of said outer band.

4. The aggregate vane assembly of claim 1 wherein said bypass vane assembly further comprises:

a bypass flow ring encircling said central longitudinal axis and said outerband and extending along said central longitudinal axis, said at least one bypass vane releasably engaged with said bypass flow ring such that said bypass flow ring and said at least one retention plate cooperate to limit movement of said at least one vane, wherein said bypass flow ring defines said second forward end and said second forward end abuts said splitter ring.

5. The aggregate vane assembly of claim 4 further comprising:

a fastener extending through and interconnecting said bypass flow ring and said at least one retention plate.

6. The aggregate vane assembly of claim 1 wherein a radial height of said flange portion is less than a radial depth of said first circumferential groove such that a radially-innermost end of said flange portion is spaced radially from the bottom wall of said first circumferential groove.

7. The aggregate vane assembly of claim 1 further comprising:

an o-ring positioned between and sealing said splitter ring and said outer band relative to one another.

8. The aggregate vane assembly of claim 7 wherein said splitter ring further comprises a second circumferential groove open radially inward relative to said central longitudinal axis, said o-ring at least partially positioned in said second circumferential groove.

9. A method comprising the steps of:

encircling a central longitudinal axis with a core vane assembly having a plurality of core vanes each extending radially between an inner hub and an outer band wherein the core vane assembly extends along the central longitudinal axis between a first forward end and a first aft end;

disposing a bypass vane assembly on a radially opposite side of the outer band relative to the plurality of core vanes, the bypass vane assembly including at least one bypass vane extending radially outward from a platform and the bypass vane assembly extending along the central longitudinal axis between a second forward end and a second aft end;

positioning a splitter ring proximate to the first forward end;

overlapping a forward end of the at least one bypass vane and-at least a portion of the splitter ring along the central longitudinal axis with at least one retention plate wherein the retention plate includes a flange extending radially away from a forward end of the retention plate; and releasably engaging the splitter ring with both of the outer band and the flange of the at least one retention plate.

10. The method of claim 9 wherein further comprises the step of:

connecting the splitter ring to the outer band and the at least one retention plate such that at least one of the outer band and the at least one retention plate is moveable relative to the splitter ring after said releasably engaging step.

11. The method of claim 9 wherein further comprises the step of:

connecting the splitter ring to the outer band and the at least one retention plate such that both of the outer band and the at least one retention plate is moveable relative to the splitter ring after said releasably engaging step.

12. The method of claim 9 further comprising the step of:

accommodating variation in the size of the outer band by positioning an elastic member between the splitter ring and the outer band.

13. The method of claim 9 further comprising the step of:

interlocking the splitter ring and the at least one retention plate together with the flange of the retention plate and a first circumferential groove defined by a pair of sidewalls and a bottom wall formed in the splitter ring.

14. The method of claim 9 further comprising the steps of:

capturing at least a first portion of the splitter ring along the central longitudinal axis between a portion of the at least one retention plate and a bypass flow ring encircling the central longitudinal axis and the outer band; and releasably attaching the at least one retention plate and the bypass flow ring together.

15. A turbine engine comprising:

a compressor section;

a core vane assembly disposed upstream of said compressor section and encircling a central longitudinal axis and having a plurality of core vanes each extending radially between an inner hub and an outer band wherein said core vane assembly extends along said central longitudinal axis between a first forward end and a first aft end;

a bypass vane assembly disposed on a radially opposite side of said outer band relative to said plurality of core vanes, said bypass vane assembly including a plurality of bypass vanes extending radially outward from a platform and said bypass vane assembly extending along said central longitudinal axis between a second forward end and a second aft end and also including a bypass flow ring encircling said central longitudinal axis and said outer band, said plurality of bypass vanes releasably engaged with said bypass flow ring;

a splitter ring positioned proximate to said first forward end and operable to bifurcate a flow of fluid into a first stream directed into said core vane assembly and said compressor section and a second stream directed across said plurality of bypass vanes and said bypass flow ring; and a plurality of retention plates, each retention plate overlapping a forward end of at least one of said plurality of bypass vanes along said central longitudinal axis and also overlapping at least a portion of said splitter ring along said central longitudinal axis, wherein said splitter ring is releasably engaged with both of said outer band and each of said plurality of retention plates;

wherein each of said plurality of retention plates includes a circumferential flange extending radially-inward from a forward end, and wherein the flange is received in a first fully annular circumferential groove with opposing sidewalls extending from a bottom wall formed in said splitter ring.

16. The turbine engine of claim 15 further comprising:

an o-ring positioned between said splitter ring and said outer band, wherein a torturous path to said o-ring for fluid flow is defined between said splitter ring and said outer band.

17. The turbine engine of claim 16 wherein said splitter ring is formed as a single, unitary structure extending 360° about said central longitudinal axis, said o-ring positioned in a second, fully annular groove defined by said splitter ring.

18. The turbine engine of claim 17 wherein the bottom wall of said first groove being spaced from a radially-inner end of said circumferential flange.

19. The turbine engine of claim 17 wherein said first and second annular grooves face in opposite radial directions relative to said central longitudinal axis.

* * * * *